US011542628B2

(12) United States Patent
Monpetit

(10) Patent No.: US 11,542,628 B2
(45) Date of Patent: Jan. 3, 2023

(54) ELECTRODE FOR AN ELOXAL PROCESS

(71) Applicant: ZF Active Safety GmbH, Koblenz (DE)

(72) Inventor: Dennis Monpetit, Kollig (DE)

(73) Assignee: ZF Active Safety GmbH, Koblenz (DE)

( * ) Notice: Subject to any disclaimer, the term of this patent is extended or adjusted under 35 U.S.C. 154(b) by 0 days.

(21) Appl. No.: 17/054,066

(22) PCT Filed: Apr. 2, 2019

(86) PCT No.: PCT/EP2019/058250
§ 371 (c)(1),
(2) Date: Nov. 9, 2020

(87) PCT Pub. No.: WO2019/214879
PCT Pub. Date: Nov. 14, 2019

(65) Prior Publication Data

US 2021/0277535 A1 Sep. 9, 2021

(51) Int. Cl.

| | |
|---|---|
| ***C25D 17/12*** | (2006.01) |
| ***C25D 11/08*** | (2006.01) |
| ***C25D 21/02*** | (2006.01) |
| ***C25D 11/02*** | (2006.01) |
| ***C25D 11/10*** | (2006.01) |

(52) U.S. Cl.
CPC ..... *C25D 17/12* (2013.01); *C25D 11/022* (2013.01); *C25D 11/08* (2013.01); *C25D 21/02* (2013.01); *C25D 11/10* (2013.01)

(58) Field of Classification Search
CPC ..... C25D 11/00–34
See application file for complete search history.

(56) References Cited

U.S. PATENT DOCUMENTS 4,376,683 A 3/1983 Hellwig et al.
5,736,014 A * 4/1998 Drese ..... C25D 5/02 118/428

(Continued)

FOREIGN PATENT DOCUMENTS

| | | |
|---|---|---|
| WO | 2003014424 A1 | 2/2003 |
| WO | 2004091906 A2 | 10/2004 |
| WO | 2006041925 A1 | 4/2006 |

OTHER PUBLICATIONS

Nomoto, Machine Translation, JP H11-061494 A (Year: 1999).*

*Primary Examiner* — Ho-Sung Chung
(74) *Attorney, Agent, or Firm* — Robert James Harwood

(57) ABSTRACT

The present disclosure relates to an electrode for eloxing a component, in particular a component of a vehicle brake system, comprising an electrolyte inlet for feeding an electrolyte into the electrode, an inlet channel, which connects the electrolyte inlet to an electrolyte outlet opening formed in the region of an outer surface of the electrode, an electrolyte inlet opening formed in the region of the outer surface of the electrode at a distance from the electrolyte outlet opening, an electrolyte flow path, which runs between the electrolyte outlet opening and the electrolyte inlet opening along the outer surface of the electrode and is designed to bring a surface portion of the component, which surface portion is to be eloxed, into fluid contact with the electrolyte flowing through the electrolyte flow path, an outlet channel, and an electrolyte outlet.

15 Claims, 9 Drawing Sheets

(56) References Cited

U.S. PATENT DOCUMENTS

| | | | | |
|---|---|---|---|---|
| 8,029,907 | B2 | 10/2011 | Kurze et al. | |
| 2004/0217012 | A1* | 11/2004 | Gramm | C25D 17/12 205/640 |
| 2017/0306519 | A1 | 10/2017 | Beauvir et al. | |
| 2020/0407868 | A1* | 12/2020 | Furukawa | B22C 23/02 |

* cited by examiner

ELECTRODE FOR AN ELOXAL PROCESS

CROSS-REFERENCE TO RELATED APPLICATIONS

This application is a national stage of International Application No. PCT/EP2019/058250, filed Apr. 2, 2019, the disclosure of which is incorporated herein by reference in its entirety, and which claimed priority to German Patent Application No. 102018110905.9, filed May 7, 2018, the disclosure of which is incorporated herein by reference in its entirety.

TECHNICAL FIELD

The present disclosure relates to an electrode for an anodizing process, to an apparatus and a process for anodizing a metal surface of a component and to a component having an anodized aluminum surface.

BACKGROUND

For reasons of weight many components of a vehicle braking system are manufactured from aluminum, whose mechanical abrasion resistance is often inadequate without additional treatment, especially when movable components are accommodated therein, for example displaceable pistons.

Anodizing, an electrolytic oxidation of aluminum, is a known method of surface finishing for producing an oxidic protective layer on aluminum by anodic oxidation. In contrast to the galvanic coating methods the protective layer is not deposited on the workpiece but rather an oxide is formed by conversion of the topmost metal layer. It affords a layer of, for example, 5 to 25 μm in thickness, which protects lower layers from corrosion and forms an extremely hard and scratch-resistant surface.

An electrical oxidation voltage is used to produce a homogeneous planar oxidation layer made of aluminum oxide [$Al_2O_3$] for example. This comprises generating a current $I_{ox}$ according to a defined current density A/dm$^2$. A homogeneous, planar blocking layer (dielectric) having pronounced phyllotopographic nonuniformities is initially formed by electrochemical means. The field lines generated by the potential are concentrated at positions of low layer thicknesses and penetrate the blocking layer.

This commences permanent formation of an aluminum oxide layer from the atomic aluminum under the blocking layer [$2Al+3H_2O+6e \blacktriangleright Al_2O_3+6H$]. Within the electrolyte the current is carried by the hydrogen ions [$H^+$], wherein at the cathode the hydrogen ions [$H^+$] are reduced to molecular hydrogen [$2H^++2e \blacktriangleright H_2$].

In contrast with a galvanic coating process the uppermost visible layer is always the "oldest" while the oxide/aluminum interface is always the "youngest".

The anodized layer thus develops from the outside inward. However, the growing oxide layer represents an ever greater resistance/an ever greater potential barrier for ion transport. In this connection, layer thickness is proportional to oxidation potential.

EP 3 088 115 A1 discloses a process, and an apparatus suitable for performance thereof, for producing a workpiece by electrochemical erosion of a starting material.

DE 10 2012 112 302 A1, DE 10 2006 034 277 A1, DE 103 41 998 A1 and WO 03/014424 A1 disclose processes and apparatuses for producing galvanic coatings.

DE 10 2008 027 094 A1 discloses a housing block for a vehicle braking system, wherein a chamber wall of a chamber of the housing block is, at least in regions, selectively surface treated.

WO 2006/041925 A1 discloses a valve for a braking system.

DE 10 2013 110 659 A1 and EP 2 857 560 B1 disclose processes for producing oxide layers on metals such as aluminum by oxygen plasma.

DE 20 2008 010 896 U1 discloses a material made of a metal or an alloy thereof having an oxide layer obtained by anodic oxidation with subsequent melt treatment.

U.S. Pat. No. 8,029,907 B2 discloses a process for producing resistant layers on metals by laser treatment.

DE 10 2004 047 423 B3 discloses nickel alloys applied without external current.

DE 103 27 365 B4 discloses an article having an anticorrosion layer produced by application of an anticorrosion solution as a layer on a metal surface and subsequent pre-drying, drying, curing and/or crosslinking of the obtained layer.

WO 2004/091906 A2 discloses the use of an article whose surface comprises a composite material.

DE 101 63 743 B4 discloses an article made of steel whose surface is covered by a coating containing a finely divided magnesium alloy comprising a phase of $Mg_{17}Al_{12}$ bound in a nonmetallic matrix. The nonmetallic matrix contains at least one binder based on a silicate and/or silane.

SUMMARY

It is an object of the present disclosure to provide an electrode with which a surface section of a component may be efficiently provided with a uniform anodized layer. It is a further object of the present disclosure to provide an apparatus and a process which make it possible to efficiently provide a component with a uniform anodized layer. It is a further object of the present disclosure to specify a component comprising a surface section anodized using such an electrode, using such an apparatus or by such a process.

This object is solved by an electrode according to claim 1, an apparatus according to claim 11 and a process according to claim 13.

An electrode for anodizing a component comprises an electrolyte inlet for feeding an electrolyte into the electrode. The electrode further comprises an inlet channel which connects the electrolyte inlet to an electrolyte exit opening arranged in the region of an outer surface of the electrode. Also formed in the region of the outer surface of the electrode, spaced apart from the electrolyte exit opening, is an electrolyte entry opening. The electrolyte entry opening is preferably arranged along a longitudinal axis of the electrode at a desired distance from the electrolyte exit opening. An electrolyte flow path runs between the electrolyte exit opening and the electrolyte entry opening along the outer surface of the electrode and is adapted to bring a surface section of the component to be anodized into fluid contact with the electrolyte flowing through the electrolyte flow path. The electrode finally comprises an outlet channel connected to the electrolyte entry opening and an electrolyte outlet connected to the outlet channel for discharging the electrolyte from the electrode.

During operation of the electrode an electrolyte supplied to the electrode via the electrolyte inlet is accordingly passed through the electrolyte exit opening into the electrolyte flow path after flowing through the inlet channel. The electrolyte flow path/a region of the outer surface of the electrode comprising the electrolyte exit opening and the electrolyte entry opening defines, together with the surface section of the component to be anodized, an electrolysis gap which is supplied with electrolyte via the electrolyte exit opening. Once it has flowed through the electrolysis gap the electrolyte is discharged from the electrolyte flow path and thus the electrolysis gap via the electrolyte entry opening. This design of the electrode enables a particularly uniform electrolyte feeding to the surface section of the component to be anodized and a particularly uniform electrolyte discharging from the surface section of the component to be anodized and consequently allows a particularly uniform buildup of the anodized layer. The electrode further features particularly efficient utilization of the electrolyte.

The component to be anodized may be a component of a vehicle braking system, in particular a hydraulic block of a traction control system. The component may be made of aluminum or have at least one surface section to be anodized which is made of aluminum. The surface section to be anodized may be for example an inner surface of a recess or bore formed in the component.

The electrolyte inlet, the inlet channel, the electrolyte outlet opening, the electrolyte flow path, the electrolyte entry opening, the outlet channel and/or the electrolyte outlet is/are preferably shaped and/or dimensioned such that a laminar electrolyte flow is established at least in the electrolyte flow path. It is preferable when the electrolyte flow is laminar in the entire electrode. In the case of laminar electrolyte flow, layers that do not mix with one another are formed in the electrolyte flow. This allows optimal removal from the electrolysis gap of the heat formed during the anodizing process. The establishment of a laminar electrolyte flow through the electrode and the resulting improved heat removal from the electrolysis gap accordingly allows for faster and thus more efficient anodizing, which is associated with higher electrolyte consumption and greater heat generation.

The flow cross sections of the electrolyte inlet, the inlet channel, the electrolyte outlet channel, the electrolyte flow path, the electrolyte entry opening, the outlet channel and/or the electrolyte outlet should in principle be shaped and dimensioned such that the highest possible electrolyte volume flow through the electrode may be realized. However, at the same time it must be ensured that no turbulences impairing the desired laminar flow are formed in the electrolyte flow. This may be achieved for example by an electrode design where a flow resistance for the electrolyte flow through the electrode is substantially constant in all traversable sections of the electrode.

In a preferred embodiment the electrode comprises a plurality of inlet channel branches. Each of the inlet channel branches may be connected to an electrolyte exit opening. The inlet channel of the electrode may further comprise an inlet channel section arranged downstream of the electrolyte inlet but upstream of the inlet channel branches. The inlet channel section which may extend substantially parallel to the longitudinal axis of the electrode for example may open into the plurality of inlet channel branches, so that the inlet channel branches connect the first inlet channel section with the plurality of electrolyte exit openings. In the context of the present application the terms "downstream" and "upstream" relate to the flow direction of the electrolyte through the electrode. The inlet channel branches and/or the electrolyte outlet openings may be arranged equidistantly in the circumferential direction of the electrode.

Alternatively or in addition the electrode may comprise a plurality of electrolyte entry openings. Each of these electrolyte entry openings may be connected to an outlet channel branch of a plurality of outlet channel branches. The outlet channel branches may open into an outlet channel section which in particular runs parallel to the longitudinal axis of the electrode downstream of the outlet channel branches and connects the outlet channel branches with the electrolyte outlet arranged downstream of the outlet channel section. The electrolyte entry opening and/or the outlet channel branches may be arranged equidistantly in the circumferential direction of the electrode.

The number of inlet channel branches and associated electrolyte inlet openings preferably corresponds to the number of electrolyte outlet openings and associated outlet channel branches. For example the electrode may comprise 2, 4, 6, 8, 10, 12, 14 or 16, in particular 10, inlet channel branches and 2, 4, 6, 8, 10, 12, 14 or 16, in particular 10, electrolyte exit openings. Furthermore the electrode may comprise 2, 4, 6, 8, 10, 12, 14 or 16, in particular 10, electrolyte entry openings and 2, 4, 6, 8, 10, 12, 14 or 16, in particular 10, outlet channel branches. The electrode is then in the form of a capillary electrode.

The inlet channel section and the outlet channel section may have identical flow cross sections. Such a design of the electrode ensures that the flow resistance for the electrolyte flow flowing through the inlet channel section corresponds substantially to the flow resistance for the electrolyte flow flowing through the outlet channel section. Alternatively or in addition the inlet channel branches and the outlet channel branches/the electrolyte outlet openings and the electrolyte inlet openings may have identical flow cross sections. This makes it possible to establish a constant flow resistance for the electrolyte flow flowing through the electrode from entry of the flow into the inlet channel branches until exit of the flow from the outlet channel branches.

In a particularly preferred embodiment of the electrode the flow cross section of the inlet channel section corresponds to the sum of the flow cross sections of the inlet channel branches. This prevents a sudden change in flow resistance upon entry of the electrolyte flow from the inlet channel section into the inlet channel branches and thus formation of turbulences in the electrolyte flow. Alternatively or in addition the flow cross section of the outlet channel section may correspond to the sum of the flow cross sections of the outlet channel branches. This prevents a sudden change in flow resistance upon entry of the electrolyte flow from the outlet channel branches into the outlet channel section and thus formation of turbulences in the electrolyte flow.

The electrode may comprise a first electrode part. The electrode may further comprise a second electrode part adjacent to the first electrode part. Finally the electrode may comprise a third electrode part adjacent to the second electrode part.

The first electrode part may comprise a cylindrical first section adapted for introduction into a recess formed in the component to be anodized. The shape of the first section of the first electrode part is preferably adapted to the shape of the recess formed in the component to be anodized. For example the first section of the first electrode part may have a circular cylindrical shape when the recess formed in the component to be anodized is a bore having a circular cross section. The first section of the first electrode part is moreover preferably shaped such that it is introducible with clearance into the recess formed in the component to be anodized.

The electrolyte exit opening and the electrolyte entry opening may be formed spaced apart from one another along the longitudinal axis of the electrode in the outer surface of the first section of the first electrode part. The electrolyte flow path preferably runs along the outer surface of the first section of the first electrode part. Accordingly, an electrolysis gap traversable by the electrolyte is preferably defined by the outer surface of the first section of the first electrode part and an inner surface of the recess formed in the component to be anodized, into which the first section of the first electrode part is introduced with clearance. The electrolysis gap preferably has a ring-shaped, especially circular ring-shaped flow cross section.

The first electrode part may further comprise a flange section which extends radially from the outer surface of the first section of the first electrode part. The flange section may carry a seal in the region of a first end face facing the component to be anodized during operation of the electrode. This seal is preferably adapted to seal the electrolysis gap defined by the outer surface of the first section of the first electrode part and the inner surface of the recess formed in the component to be anodized during operation of the electrode.

A cylindrical second section of the first electrode part may extend from a second end face of the flange section facing away from the component to be anodized during operation of the electrode. The second section of the first electrode part especially extends along the longitudinal axis of the electrode from the second end face of the flange section. When the electrode is in operation the second section of the first electrode part, similarly to the flange section, is preferably arranged outside the recess formed in the component to be anodized.

The first electrode part is preferably penetrated by a through-bore extending along the longitudinal axis of the electrode. One section of this through-bore may form the outlet channel section arranged downstream of the outlet channel branches. The through-bore is preferably fluid-tightly sealed by means of a further seal in the region of an end facing the component to be anodized during operation of the electrode. This prevents electrolyte supplied to the through-bore for example via the outlet channel branches from exiting the through-bore in uncontrolled fashion.

The inlet channel branches of the inlet channel are preferably formed in the first electrode part. In particular, the inlet channel branches formed in the first electrode part may extend from the second end face of the flange section to the electrolyte exit openings in the flow direction of the electrolyte flowing through the inlet channel branches initially inclined radially inwardly relative to the longitudinal axis of the electrode and subsequently inclined radially outwardly relative to the longitudinal axis of the electrode. Furthermore, the outlet channel branches of the outlet channel are preferably also formed in the first electrode part. The outlet channel branches formed in the first electrode part may extend radially inwardly from the electrolyte entry openings and open into the through-bore penetrating the first electrode part, i.e. the part of the through-bore forming the outlet channel section. For example the outlet channel branches may run substantially parallel to the sections of the inlet channel branches inclined radially outwardly relative to the longitudinal axis of the electrode.

Similarly to the first electrode part, the second electrode part of the electrode is preferably penetrated by a through-bore extending along the longitudinal axis of the electrode. The through-bore formed in the second electrode part is preferably adapted to accommodate the further cylindrical section of the first electrode part. The inlet channel section of the inlet channel arranged upstream of the inlet channel branches is preferably formed in the second electrode part. In particular the inlet channel section formed in the second electrode part may extend substantially parallel to the longitudinal axis of the electrode from a first end face of the second electrode part facing the component to be anodized during operation of the electrode in the direction of a second end face of the second electrode part facing away from the component to be anodized during operation of the electrode. The inlet channel section formed in the second electrode part preferably has a ring-shaped flow cross section.

A first connecting channel connected to the electrolyte inlet may further be formed in the second electrode part. This connecting channel may extend substantially perpendicularly to the longitudinal axis of the electrode and form a fluid-conducting connection between the electrolyte inlet which may be formed in the region of an outer surface of the second electrode part and the inlet channel section formed in the second electrode part.

The third electrode part preferably comprises a main body and a cylindrical protruding section which extends along the longitudinal axis of the electrode. During operation of the electrode the protruding section preferably projects in the direction of the component to be anodized. The protruding section may especially be accommodated in the through-bore penetrating the second electrode part adjacent to the further cylindrical section of the first electrode part.

A second connecting channel connected to the electrolyte outlet may be formed in the third electrode part. The connecting channel preferably comprises a first section which penetrates the protruding section along the longitudinal axis of the electrode. The connecting channel may further comprise a second section which in the region of the main body extends substantially perpendicularly to the longitudinal axis of the electrode in the direction of the electrolyte outlet. The connecting channel may form a fluid-conducting connection between the electrolyte outlet formed in the region of an outer surface of the third electrode part and the outlet channel section formed in the first electrode part.

An apparatus for anodizing a component, in particular a component of a vehicle braking system, comprises an above-described electrode. The apparatus further comprises an electrolyte circuit for feeding electrolyte to the electrode and for discharging electrolyte from the electrode. The electrolyte circuit may have an electrolyte source arranged in it. A conveying means for conveying the electrolyte through the electrolyte circuit, for example in the form of a pump, may also be provided in the electrolyte circuit. The apparatus finally comprises a voltage source. The voltage source is connectable to the component to be anodized and the electrode and is adapted for applying opposite voltages to the component and the electrode. The voltage source is preferably used to apply a negative voltage to the electrode, i.e. the electrode is operated as a cathode. Accordingly the voltage source is preferably used to apply a positive voltage to the component to be anodized, i.e. the component to be anodized is operated as an anode.

In a preferred embodiment the apparatus further comprises a cooling apparatus adapted for cooling the electrode, the component and/or the electrolyte. By providing a cooling apparatus the removal of the heat generated by the anodizing process is improved, thus making it possible to accelerate, and therefore improve the efficiency of, the anodizing process. The cooling apparatus may in particular be arranged in the electrolyte circuit and adapted for cooling the electrolyte flowing through the electrolyte circuit.

In a process for anodizing a component, in particular a component of a vehicle braking system, an electrolyte is supplied to an electrode through an electrolyte inlet. The electrolyte is passed through an inlet channel which connects the electrolyte inlet to an electrolyte exit opening formed in the region of an outer surface of the electrode. The electrolyte is further passed through an electrolyte entry opening formed in the region of the outer surface of the electrode spaced apart from the electrolyte exit opening. The electrolyte is moreover passed through an electrolyte flow path running between the electrolyte exit opening and the electrolyte entry opening along the outer surface of the electrode. The electrolyte is brought into fluid contact with a surface section of the component to be anodized upon flowing through the electrolyte flow path. After flowing through the electrolyte flow path the electrolyte is passed through an outlet channel connected to the electrolyte entry opening and finally discharged from the electrode through an electrolyte outlet connected to the outlet channel. During the anodizing process opposite voltages are applied to the component to be anodized and the electrode. It is preferable to apply a positive voltage to the component to be anodized and a negative voltage to the electrode.

The temperature of the electrolyte may be set to −10° C. to +20° C., wherein a particularly preferred electrolyte temperature is about 10° C. The voltage may be increased from 0 V to a maximum voltage of 30 V over a defined period, so that in this period the current increases from 0 A to a current which is higher than 0 A but not more than 2 A. The electrolyte, the electrode and/or the component may further be cooled to remove heat formed during the anodization.

In a particularly preferred embodiment of the process for anodizing a component a cylindrical first section of a first electrode part, in whose outer surface the electrolyte exit opening and the electrolyte entry opening are formed spaced apart from one another along a longitudinal axis of the electrode and/or along whose outer surface the electrolyte flow path runs, is introduced into a recess formed in the component to be anodized. As a result, as described hereinabove in connection with the description of the setup of the electrode, the outer surface of the first section of the first electrode part and the inner surface of the recess formed in the component to be anodized define an electrolysis gap through which electrolyte flows. An inner surface of the recess formed in the component may accordingly be reliably and efficiently anodized.

A component comprises a surface section anodized by means of an above-described electrode, by means of an above-described apparatus or by an above-described process. The anodized surface section is in particular an aluminum surface section.

An anodized layer produced on the surface section preferably has a hexagonal, tubular pore structure which is detectable for example by means of suitable methods of microscopy, especially scanning electron microscopy.

BRIEF DESCRIPTION OF THE DRAWINGS

Preferred embodiments of the present disclosure are hereinbelow more particularly elucidated with reference to the accompanying schematic diagrams, where.

DETAILED DESCRIPTION

Figure 25:
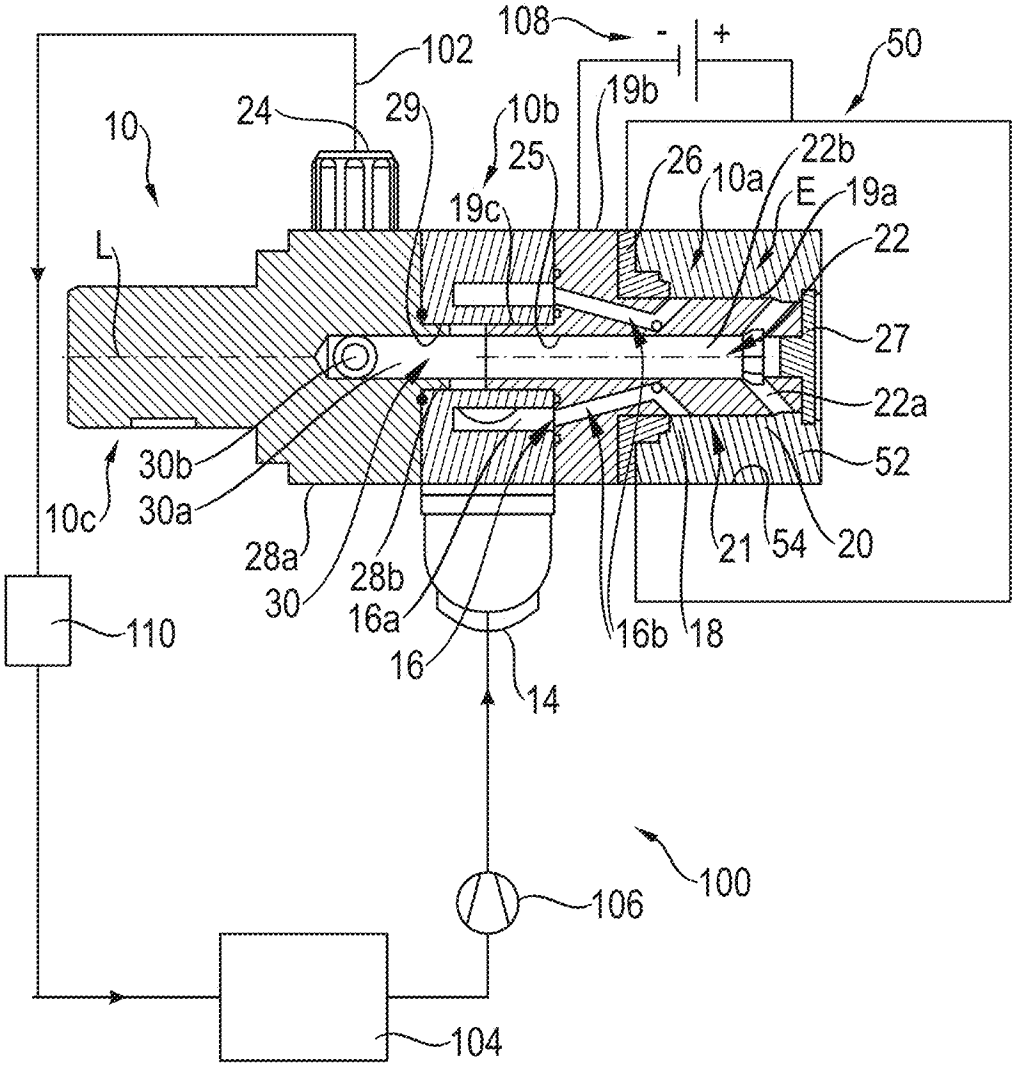
FIG. 25 shows the electrode of FIG. 1 during use for anodizing an inner surface of a bore formed in a component of a vehicle braking system.

FIGS. 1 to 24 show an electrode 10 for use in an apparatus 100 for anodizing a component 50 illustrated in FIG. 25. In the working example shown here the component 50 is a component of a vehicle braking system, in particular a hydraulic block of a traction control system. The electrode 10 comprises a first electrode part 10*a* illustrated in more detail in FIGS. 5 to 11, a second electrode part 10*b* illustrated in more detail in FIGS. 12 to 16 and a third electrode part 10*c* illustrated in more detail in FIGS. 17 to 20.

An electrolyte inlet 14 for feeding an electrolyte into the electrode 10 is arranged in the region of an outer surface of the second electrode part 10*c* and connected via a first connecting channel 15 formed in the second electrode part 10*c* to an inlet channel 16. The inlet channel 16 ensures formation of a fluid-conducting connection between the electrolyte inlet 14 and at least one electrolyte exit opening 18 formed in the region of an outer surface of the electrode 10.

Figure 14:
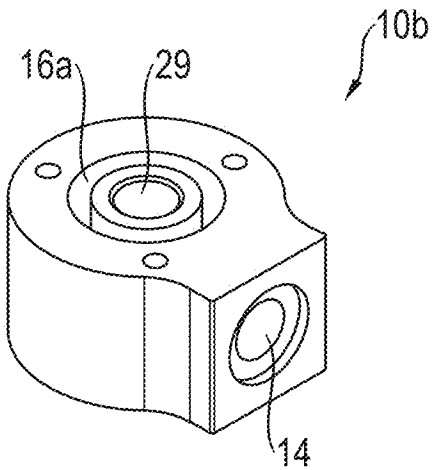
FIG. 14 shows a three-dimensional view of the second electrode part of FIG. 12.
Figure 15:
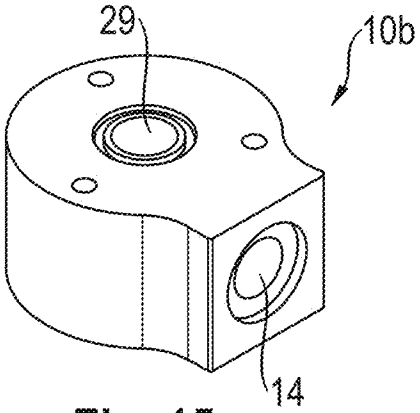
FIG. 15 shows a three-dimensional view of the second electrode part of FIG. 14 rotated by 180°.
Figure 13:
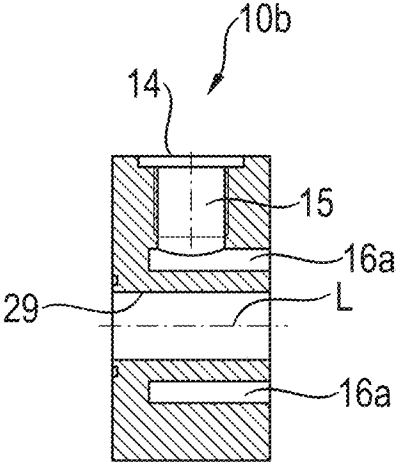
FIG. 13 shows a longitudinal section view of the second electrode part of FIG. 12.
Figure 12:
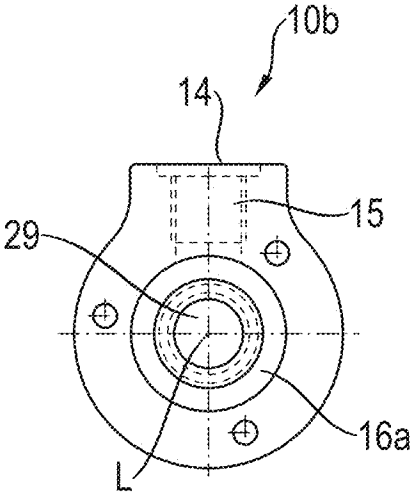
FIG. 12 shows a front view of a second part of the electrode of FIG. 1.
Figure 16:
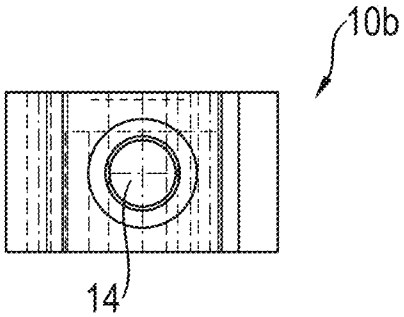
FIG. 16 shows a side view of the second electrode part of FIG. 12.
Figure 20:
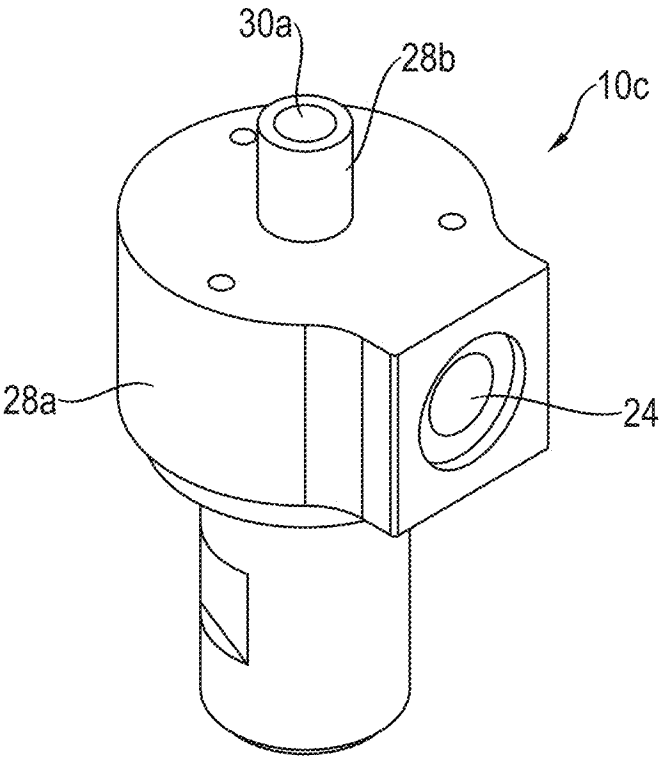
FIG. 20 shows a three-dimensional view of the third electrode part of FIG. 17.
Figure 18:
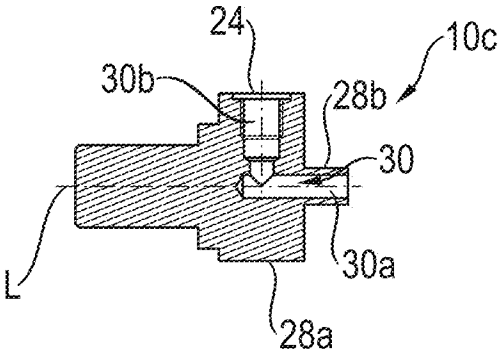
FIG. 18 shows a longitudinal section view of the third electrode part of FIG. 17.
Figure 17:
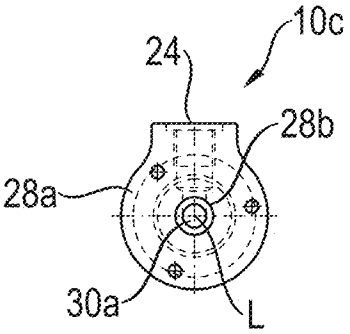
FIG. 17 shows a front view of a third part of the cathode of FIG. 1.
Figure 19:
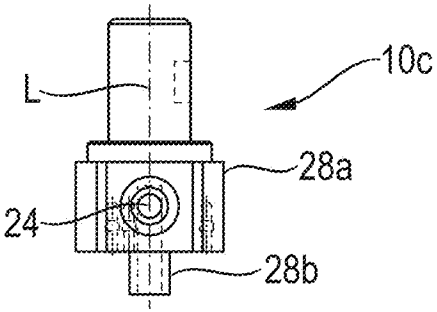
FIG. 19 shows a side view of the third electrode part of FIG. 17.

As is most apparent from FIGS. 13 and 14 the first connection channel 15 extends substantially perpendicularly to a longitudinal axis L of the electrode 10 and constitutes a fluid-conducting connection between the electrolyte inlet 14 and an inlet channel section 16*a* formed in the second electrode part. The inlet channel section 16*a* has a circular ring-shaped flow cross section and extends substantially parallel to the longitudinal axis L of the electrode 10 from a first end face of the second electrode part 10*b* facing the component 50 to be anodized during operation of the electrode 10 in the direction of a second end face of the second electrode part 10*b* facing away from the component 50 to be anodized during operation of the electrode. The inlet channel section 16*a* especially extends concentrically around the longitudinal axis L of the electrode 10 (see especially FIGS. 13 and 14). The inlet channel section 16*a* opens into a plurality of inlet channel branches 16*b* formed in the first electrode part 10*a* and each connected to an electrolyte exit opening 18.

The first electrode part 10*a* has a cylindrical first section 19*a* which is shaped and dimensioned such that it may be introduced into a recess 52 formed in the component 50 to be anodized, see FIG. 25. In the working example shown here the recess 52 is in the form of a bore such as is provided for example in a hydraulic block of a traction control system of a vehicle braking system. The first electrode part 10*a* moreover has a flange section 19*b* which extends radially outward from the outer surface of the first section 19*a*. A first end face of the flange section 19*b* faces the component 50 to be anodized during operation of the electrode 10 while a second end face of the flange section 19*b*, opposite to the first end face, faces away from the component 50 to be anodized during operation of the electrode 10. Finally, the first electrode part 10*a* comprises a further cylindrical section 19*c* which extends from the second end face of the flange section 19*b* along the longitudinal axis L of the electrode 10.

The inlet channel branches 16*b* formed in the first electrode part 10*a* extend from the second end face of the flange section 19*b* in the flow direction of the electrolyte flowing through the inlet channel branches 16*b* in the direction of the electrolyte exit openings 18 initially inclined radially inwardly relative to the longitudinal axis L of the electrode 10 and subsequently inclined radially outwardly relative to the longitudinal axis L of the electrode 10, see in particular FIGS. 1, 8 and 25. The electrolyte exit openings 18 are formed in an outer surface of the cylindrical first section 19*a* of the first electrode part 10*a*. The inlet channel branches 16*b* and the electrolyte outlet opening in 18 are in particular arranged equidistantly, i.e. at the same distances from one another, in the circumferential direction of the electrode 10, see in particular FIG. 11.

Formed in the region of the outer surface of the electrode 10 spaced apart from the at least one electrolyte exit opening 18 is at least one electrolyte entry opening 20. Running along the outer surface of the electrode 10 between the at least one electrolyte exit opening 18 and the at least one electrolyte entry opening 20 is an electrolyte flow path 21 adapted to bring a surface section 54 of the component 50 to be anodized into fluid contact with the electrolyte flowing through the electrolyte flow path 21. The electrolyte entry opening 20 is connected to an outlet channel 22 which is itself connected to an electrolyte outlet 24 for discharging the electrolyte from the electrode 10.

Figure 1:
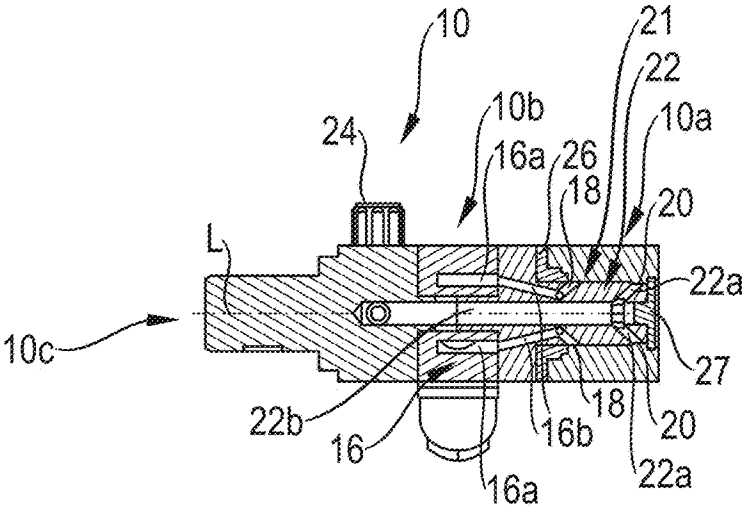
FIG. 1 shows a longitudinal section view of an electrode for an anodizing process.
Figure 2:
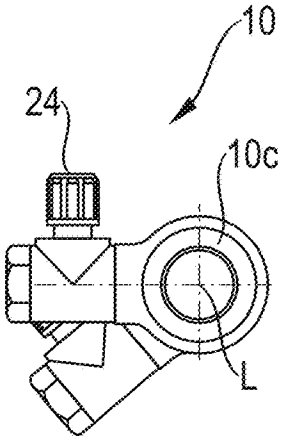
FIG. 2 shows a rear view of the electrode of FIG. 1.
Figure 3:
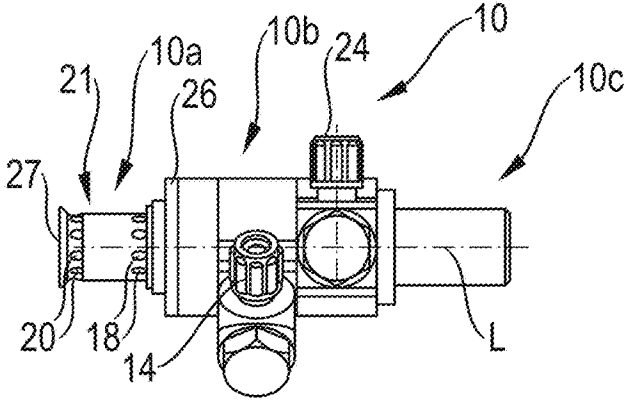
FIG. 3 shows a side view of the electrode of FIG. 1 rotated by 180° compared to FIG. 1 which illustrates a plurality of exit openings and a plurality of entry openings.
Figure 4:
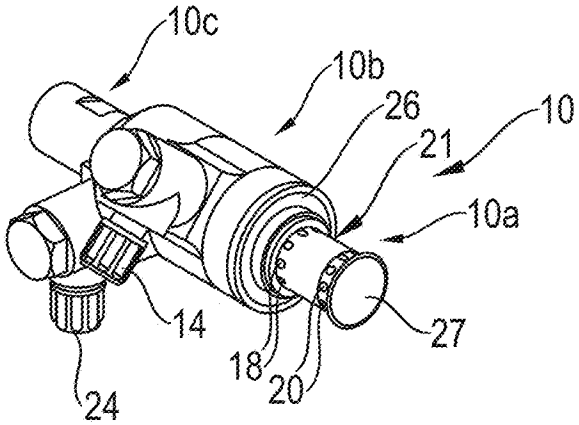
FIG. 4 shows a three-dimensional view of the electrode of FIG. 1.
Figure 7:
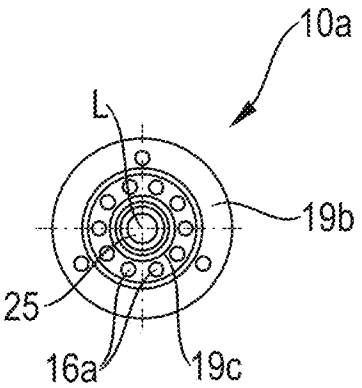
FIG. 7 shows a front view of the first electrode part of FIG. 5.
Figure 6:
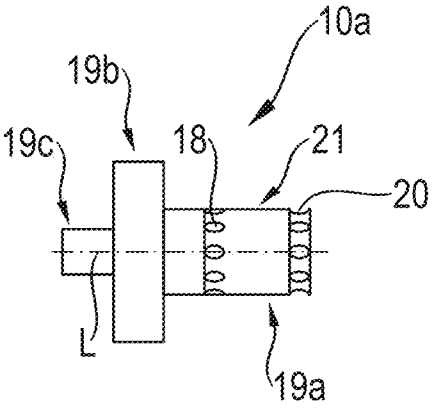
FIG. 6 shows a side view of the first electrode part of FIG. 5.
Figure 5:
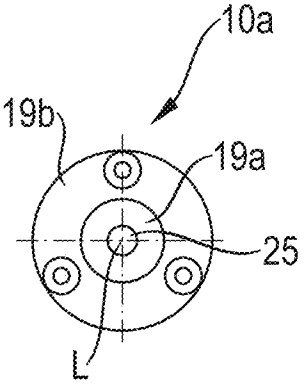
FIG. 5 shows a front view of a first part of the electrode of FIG. 1.
Figure 8:
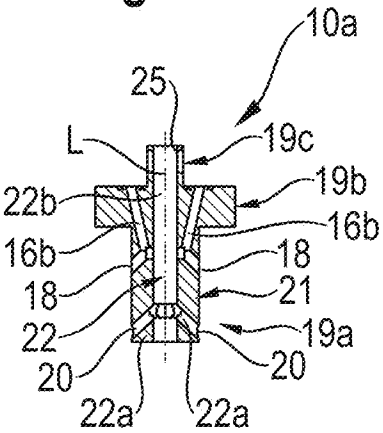
FIG. 8 shows a longitudinal section view of the first electrode part of FIG. 5.

In the exemplary embodiment shown here the electrode 10 comprises a plurality of electrolyte entry openings 20 formed in the first electrode part 10*a*, i.e. in the cylindrical first section 19*a* of the first electrode part 10*a*, each of which open into an outlet channel branch 22*a* formed in the first electrode part 10*a*, i.e. in the cylindrical first section 19*a* of the first electrode part 10*a*, see in particular FIGS. 1, 8 and 25. The outlet channel branches 22*a* run substantially parallel to the sections of the inlet channel branches 16*b* inclined radially outwardly relative to the longitudinal axis L of the electrode 10 and open into a through-bore 25 penetrating the first electrode part 10*a*. The through-bore 25 extends along the longitudinal axis L of the electrode 10 and comprises a section forming an outlet channel section 22*b* arranged downstream of the outlet channel branches 22*a*.

Figure 11:
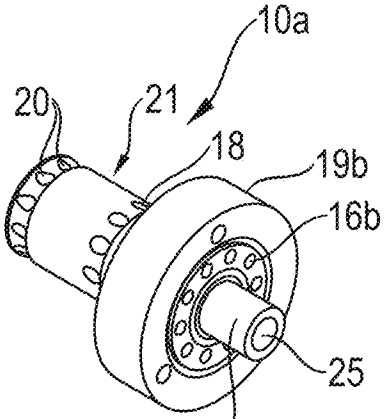
FIG. 11 shows a three-dimensional view of the first electrode part of FIG. 5 rotated by 180° compared to FIG. 10.
Figure 10:
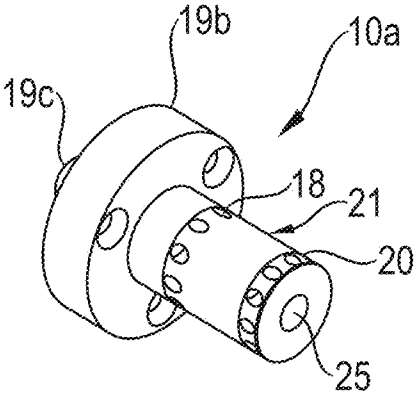
FIG. 10 shows a three-dimensional view of the first electrode part of FIG. 5.
Figure 9:
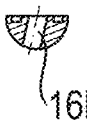
FIG. 9 shows a detailed view of an entry region of an inlet channel branch formed in the first electrode part of FIG. 8.

Similarly to the inlet channel branches 16*b* and the electrolyte exit openings 18, the electrolyte entry openings 20 and the outlet channel branches 22*a* are also arranged equidistantly, i.e. at the same distances from one another, in the circumferential direction of the electrode 10, see in particular FIG. 11. The electrolyte entry openings 20 are arranged along the longitudinal axis L of the electrode 10 at a distance from the electrolyte exit openings 18 which is adapted to the geometry of the recess 52 formed in the component 50 to be anodized. For example the distance between the electrolyte exit openings 18 and the electrolyte entry openings 20 may be about 1-100 mm, about 2-50 mm or about 5-20 mm.

In the working example of an electrode 10 illustrated in the figures the electrolyte flow path 21 runs along the outer surface of the first cylindrical section 19*a* of the first electrode part 10*a* which is accommodated in the recess 52 formed in the component 50 to be anodized. Accordingly, the outer surface of the first cylindrical section 19*a* of the first electrode part 10*a* and an inner surface of the recess 52 define an electrolysis gap E which has a circular ring-shaped flow cross section having a radial dimension of about 1-100 mm, about 2-50 mm, about 5-20 mm or about 10 mm.

Figure 21:
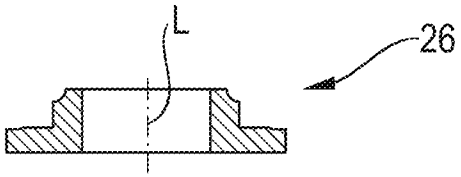
FIG. 21 shows a longitudinal section view of a first seal for sealing the first electrode part with respect to a bore formed in a component to be anodized.
Figure 22:
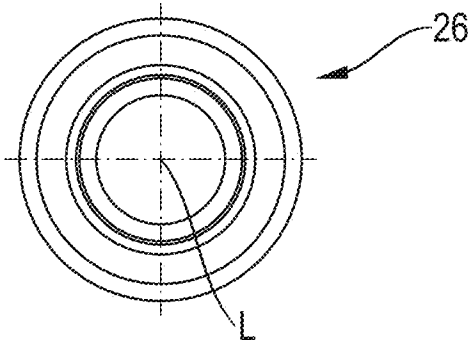
FIG. 22 shows a front view of the seal of FIG. 21.
Figure 23:
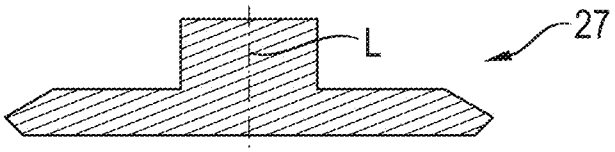
FIG. 23 shows a longitudinal section view of a second seal for sealing a front end of a main channel section formed in the first electrode part.
Figure 24:
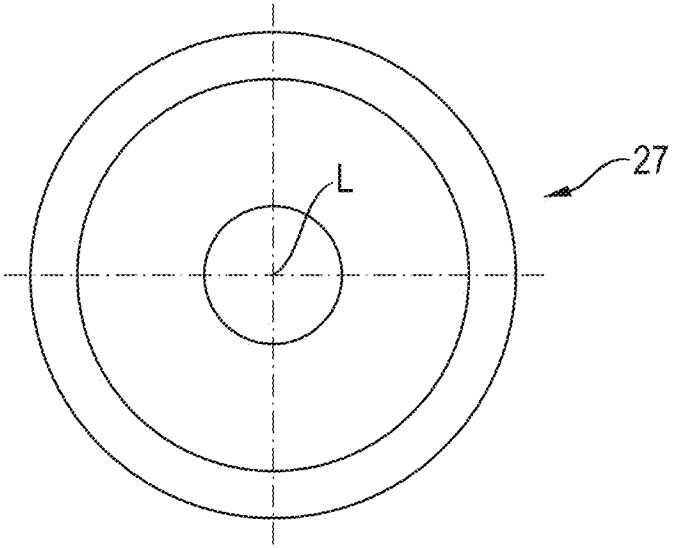
FIG. 24 shows a rear view of the seal of FIG. 23.

In order to prevent escape of electrolyte from the electrolysis gap E during operation of the electrode 10, the electrode 10 comprises a seal 26 illustrated in detail in FIGS. 21 and 22. The seal 26 is carried by the first end face of the flange section 19*b* of the first electrode part 10*a*, see especially FIGS. 1 and 25. A further seal 27, which is illustrated in detail in FIGS. 23 and 24, seals an end of the through-bore 25 penetrating the first electrode part 10*a* that faces the component 50 to be anodized during operation of the electrode 10. The further seal 27 thus prevents uncontrolled escape of electrolyte from the outlet channel section 22*b*.

The third electrode part 10*c* has a main body 28*a* and a cylindrical protruding section 28*b* which extends along the longitudinal axis L of the electrode 10. During operation of the electrode 10, the protruding section 28*b* projects in the direction of the component 50 to be anodized and is accommodated in a through-bore 29 penetrating the second electrode part 10*b*. The through-bore 29 formed in the second electrode part 10*b* also accommodates the further cylindrical section 19*c* of the first electrode part 10*a*, so that the protruding section 28*b* adjacent to the further cylindrical section 19*c* of the first electrode part 10*a* is arranged in the through-bore 29 formed in the second electrode part 10*b*.

A second connecting channel 30 is formed in the third electrode part 10*c*. The second connecting channel 30 comprises a first section 30*a* penetrating the protruding section 28*b* along the longitudinal axis L of the electrode 10 and a second section 30*b* running substantially perpendicularly to the longitudinal axis L of the electrode 10 in the region of the main body 28*a*. The connecting channel 30 forms a fluid-conducting connection between the electrolyte outlet 24 formed in the region of an outer surface of the third electrode part 10*c* and the outlet channel section 22*b* formed in the first electrode part 10*a*.

The electrolyte inlet 14, the inlet channel 16, i.e. the inlet channel section 16*a* and the inlet channel branches 16*b*, the electrolyte outlet openings 18, the electrolyte flow path 21, the electrolyte entry openings 20, the outlet channel 22, i.e. the inlet channel branches 22*a* and the outlet channel section 22*b*, and the electrolyte outlet 24 of the electrode 10 are shaped and dimensioned such that a laminar electrolyte flow is established at least in the electrolyte flow path 21 but especially in the entire electrode 10. At the same time the flow cross sections of the electrolyte inlet 14, the inlet channel 16, i.e. the inlet channel section 16*a* and the inlet channel branches 16*b*, the electrolyte outlet openings 18, the electrolyte flow path 21, the electrolyte entry openings 20, the outlet channel 22, i.e. the outlet channel branches 22*a* and the outlet channel section 22*b*, and the electrolyte outlet 24 are shaped and dimensioned such that the highest possible electrolyte volume flow through the electrode 10 may be realized without the formation of turbulences that impair the desired laminar flow. This is achieved by an electrode design which ensures a flow resistance for the electrolyte flow through the electrode that is substantially constant in all traversable sections of the electrode 10.

In the working example of an electrode 10 shown in the figures the number of inlet channel branches 16*b* and associated electrolyte inlet openings 18 corresponds to the number of electrolyte outlet openings 20 and associated outlet channel branches 22*a*. In particular, for the electrode 10 the number of inlet channel branches 16*b*, electrolyte exit openings 18, electrolyte entry openings 20 and outlet channel branches 22*b* is in each case 10—the electrode 10 is accordingly in the form of a capillary electrode.

The inlet channel section 16*a* and the outlet channel section 22*b* each have identical flow cross sections. In addition, the inlet channel branches 16*b* and the outlet channel branches 22*a* and also the electrolyte outlet openings 18 and the electrolyte inlet openings 20 each have identical flow cross sections. The flow cross section of the inlet channel section 16*a* especially corresponds to the sum of the flow cross sections of the inlet channel branches 16*b*. In addition, the flow cross section of the outlet channel section 22*b* corresponds to the sum of the flow cross sections of the outlet channel branches 22*a*. This makes it possible to establish a constant flow resistance for the electrolyte flow flowing through the electrode 10 from entry of the flow into the inlet channel 16 until exit of the flow from the outlet channel 22.

For example, the inlet channel branches 16*b* and the outlet channel branches 22*a* and also the electrolyte outlet openings 18 and the electrolyte inlet openings 20 may have a circular flow cross section having a diameter of 0.1 to 10 mm, 0.2 and 5 mm or 0.5 and 2 mm. The inlet channel section 16*a* and the outlet channel section 22*b* may have a circular flow cross section having a diameter of 1 to 100 mm, 2 to 50 mm or 5 to 20 mm. When in the electrode 10 shown here having 10 inlet channel branches 16*b*, electrolyte outlet openings 18, electrolyte inlet openings 20 and outlet channel branches 22*a* respectively the diameter of the inlet channel branches 16*b*, the electrolyte outlet openings 18, the electrolyte inlet openings 20 and the outlet channel branches 22*a* is 1 mm in each case, the diameter of the inlet channel section 16*a* and of the outlet channel section 22*b* is preferably 10 mm.

The apparatus 100 for anodizing a component 50 illustrated in FIG. 25 comprises not only the electrode 10 but also an electrolyte circuit 102 for feeding electrolyte to the electrode 10 and for discharging electrolyte from the electrode 10. Arranged in the electrolyte circuit 102 is an electrolyte source 104 and a conveying means 106 in the form of a pump for conveying the electrolyte through the electrolyte circuit 102. A voltage source 108 which is connectable to the component 50 to be anodized and the electrode 10 is used to apply opposite voltages to the component 50 and the electrode. In particular, the voltage source 108 is used to apply a positive voltage to the component 50 while a negative voltage is applied to the electrode 10, i.e. the electrode 10 is used as a cathode. Finally arranged in the electrolyte circuit 102 is a cooling apparatus 110 which serves to cool the electrolyte flowing through the electrolyte circuit 102 and thus remove heat generated by the anodizing process from the electrolyte circuit 102.

In a process for anodizing the component 50 using the electrode 10 and the apparatus 100 an electrolyte is supplied to the electrode 10 through the electrolyte inlet 14. Employable electrolytes include for example a sulfuric acid solution (for example 220 g/L of a 90% sulfuric acid solution), a Ti K oxalate, an oxalic acid solution, a tartaric acid solution, a phosphoric acid-based solution or a solution based on citric acid and a wetting agent (surfactant). The electrolyte preferably comprises no chromium ions. The temperature of the electrolyte is set to a temperature of −10° C. to +20° C., in particular +10° C.

Anodizing is an exothermic process. Heat can lead to lattice defects in the hexagonal structure during layer formation. This results in a reduced wear resistance of the layer. In some cases the component could even become the true anode again and be oxidized so as to dissolve. The above-mentioned temperatures of the electrolyte ensure orderly commencement of the anodizing process.

The electrolyte is passed through the inlet channel 16, i.e. the inlet channel section 16*a* and the inlet channel branches 16*b*, and the electrolyte exit openings 18 in the electrolyte flow path 21. After flowing through the electrolyte flow path 21 the electrolyte is supplied via the electrolyte entry openings 20 and the outlet channel 22, i.e. the outlet channel branches 22*a* and the outlet channel section 22*b*, to the electrolyte outlet 24 and finally discharged from the electrode 10. While the electrolyte flows through the electrolyte flow path 21 and consequently through the electrolysis gap E defined by the outer surface of the cylindrical first section 19*a* of the first electrode part 10*a* and the surface section 54 to be anodized, i.e. the inner surface of the recess 52 formed in the component 50, the voltage source 108 is used to apply opposite voltages to the electrode 10 and the component to be anodized 50.

In the working example shown in the figures the component 50 is made of aluminum or is at least provided with a surface section 54 to be anodized which is made of aluminum. Accordingly, anodic oxidation produces an oxidic protective layer (anodized layer) on the surface section 54 made of aluminum. During the oxidation process the electrolyte constantly evolves oxygen and is thus at least partially consumed. After being conveyed back to the electrolyte source 104 the electrolyte may therefore be mixed with new, unconsumed electrolyte before once again being fed to the electrode 10. The aging of the electrolyte circulating in the electrolyte circuit 102 may be monitored. The electrolyte may be replaced upon exceeding predetermined threshold values.

In operation of the apparatus 100 the voltage source 104 is controlled according to a predefined voltage curve which may appear as shown in the following table for example.

| Voltage (V) | Current (A) | Time (s) | Process |
|---|---|---|---|
| 22.00 | 0.20 | 12.00 | Basic roughness |
| 23.00 | 0.50 | 14.00 | Basic roughness |
| 23.00 | 0.60 | 30.00 | Basic roughness |
| 25.30 | 0.70 | 30.00 | Layer thickness |
| 25.30 | 1.20 | 30.00 | Layer thickness |
| 25.30 | 2.00 | 30.00 | Layer thickness |

As is apparent from the table the voltage applied to the electrode 10/the component 50 may be controlled such that in a period of 12-30 seconds the voltage is increased from 22 V to 25.30 V while the current density is increased from 0.20 to 2.00 A.

Without wishing to be bound to a particular theory the following describes a possible interpretation of the procedure during application of the voltage. In the first milliseconds the electrical current forms a blocking layer consisting of crystals having a high dielectric strength. After dielectric breakdown of the blocking layer the anodized layer begins to grow, thus increasing layer thickness. The voltage may be increased from 0 V to a maximum voltage of 30 V over a defined period (of 10 or 20 seconds for example), so that in this period the current increases from 0 A to a current which is higher than 0 A but not more than 2 A. The voltages and currents may be varied and chosen according to the component.

Using the electrode 10, the apparatus 100 and the above-described process, the surface section 54 of the component 50 which is here formed by an inner surface of the recess 52 formed in the component 50 may be provided with an anodized layer. An aluminum oxide layer having a high degree of wear resistance may in particular be produced on the surface section 54 made of aluminum. The anodized layer built up on the surface section 54 has a hexagonal, tubular pore structure as is discernible in the scanning electron microscope images of FIGS. 26 and 27. $O^{2-}/OH^{-}$ ions can drift through these pore structures and be converted into aluminum oxide [$Al_2O_3$] directly at the interface of oxide and metal. The hexagonal, tubular pore structures discernible in FIGS. 26 and 27 exhibit a particularly high wear resistance in the case of wear processes applied, especially via transverse forces, by pistons to a cylindrical surface.

Example

A component having an aluminum surface was anodized using the electrode described herein. The electrolyte employed was a sulfuric acid solution (220 g/l of a 90% sulfuric acid solution). The temperature was adjusted to +10° C. The anodizing process generated heat which can influence the efficiency of the process and was therefore continuously removed.

The following voltage curve was applied:

| Voltage (V) | Current (A) | Time (s) | Process |
|---|---|---|---|
| 22.00 | 0.20 | 12.00 | Basic roughness |
| 23.00 | 0.50 | 14.00 | Basic roughness |
| 23.00 | 0.60 | 30.00 | Basic roughness |
| 25.30 | 0.70 | 30.00 | Layer thickness |
| 25.30 | 1.20 | 30.00 | Layer thickness |
| 25.30 | 2.00 | 30.00 | Layer thickness |

Figure 26:
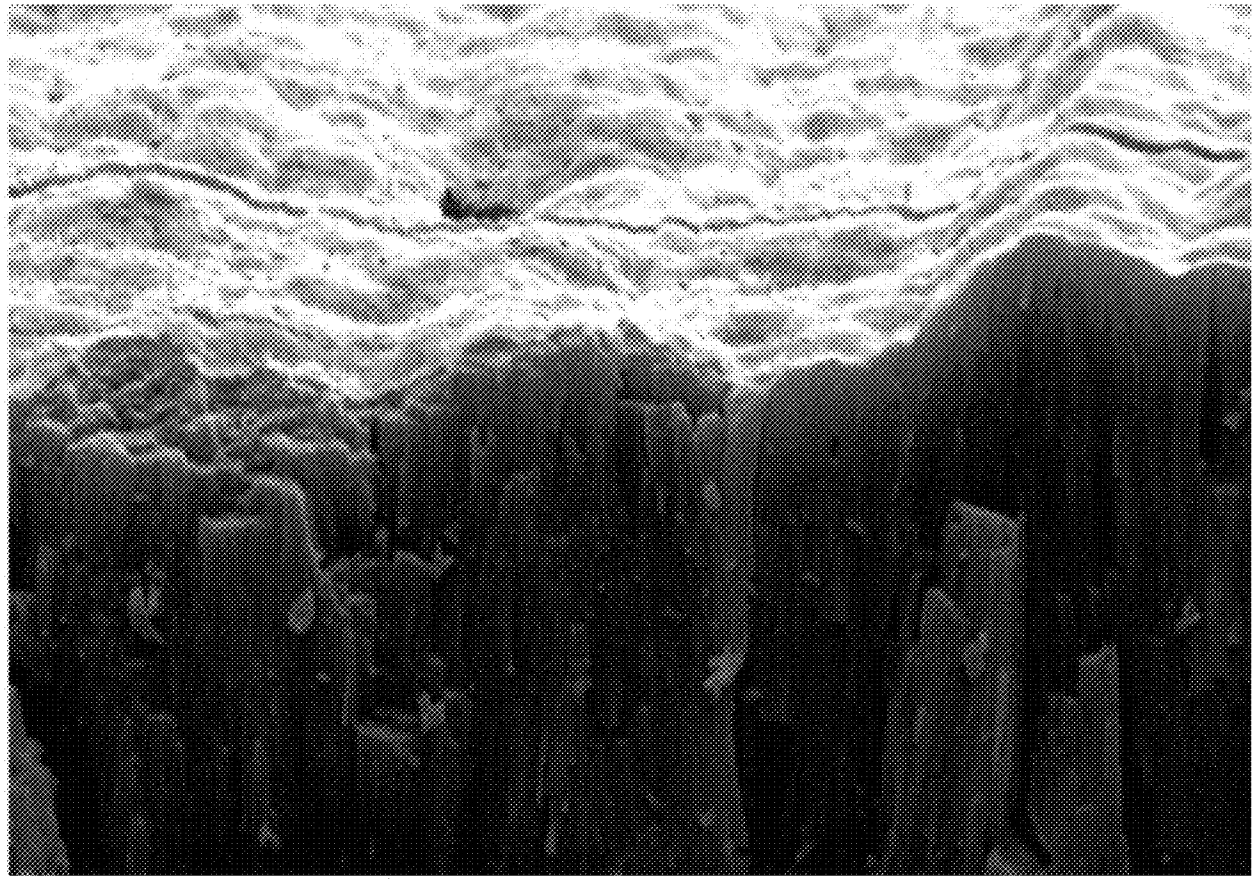
FIG. 26 shows scanning electron microscope (SEM) images of an anodized component surface.
Figure 27:
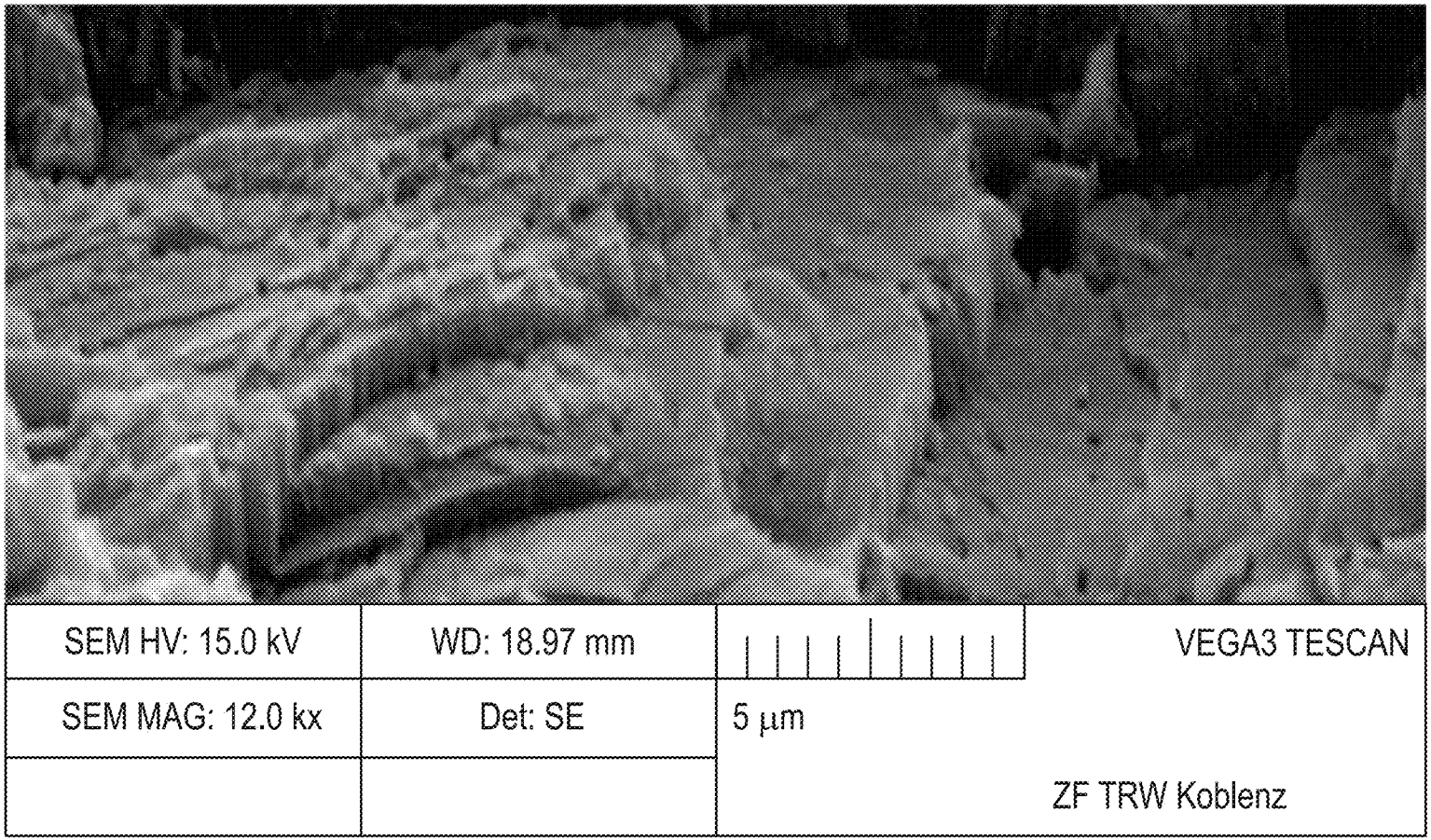
FIG. 27 shows scanning electron microscope (SEM) images of an anodized component surface.

The FIGS. 26-27 show aluminum oxide anodized layers having the specific structures produced according to the described process. Before acquisition of the images the treated component was shock-frozen with nitrogen and mechanically fractured at the height of the treated surface. The surface structures thus revealed are specific to the described process and are distinguishable from surfaces produced with conventional anodizing processes.

The invention claimed is:

1. An electrode for anodizing a component, comprising:

an electrolyte inlet for feeding an electrolyte into the electrode, an inlet channel which connects the electrolyte inlet to a plurality of electrolyte exit openings in an outer surface of the electrode, a plurality of electrolyte entry openings in the outer surface of the electrode and each of the electrolyte entry openings being spaced longitudinally apart from each of the electrolyte exit openings, an electrolyte flow path that runs longitudinally between the electrolyte exit opening and the electrolyte entry opening along the outer surface of the electrode and is adapted to bring a surface section of the component to be anodized into fluid contact with the electrolyte flowing through the electrolyte flow path, an outlet channel connected to the plurality of electrolyte entry openings and an electrolyte outlet connected to the outlet channel for discharging the electrolyte from the electrode.

2. The electrode as claimed in claim 1, wherein the electrolyte inlet, the inlet channel, the plurality of electrolyte exit openings, the electrolyte flow path, the plurality of electrolyte entry openings, the outlet channel and/or the electrolyte outlet is/are shaped and/or dimensioned such that a laminar electrolyte flow is established at least in the electrolyte flow path.

3. The electrode as claimed in claim 2, wherein the inlet channel comprises:

a plurality of inlet channel branches each connected to an associated electrolyte exit opening, or a plurality of inlet channel branches each connected to an associated electrolyte exit opening, an inlet channel section being arranged upstream of the inlet channel branches, wherein the inlet channel branches and/or the electrolyte exit openings are arranged equidistantly in a circumferential direction of the electrode, wherein the outlet channel comprises:

a plurality of outlet channel branches each connected to an associated electrolyte entry opening, or a plurality of outlet channel branches each connected to an associated electrolyte entry opening, an outlet channel section being arranged downstream of the outlet channel branches, wherein the electrolyte entry openings and/or the outlet channel branches are arranged equidistantly in the circumferential direction of the electrode.

4. The electrode as claimed in claim 3, wherein:

a number of inlet channel branches is equal to a number of outlet channel branches, and/or a number of electrolyte exit openings is equal to a number of electrolyte entry openings.

5. The electrode as claimed in claim 4, wherein:

the inlet channel section and the outlet channel section have the same identical flow cross sections, and/or the inlet channel branches, the electrolyte exit openings, the electrolyte entry openings and/or the outlet channel branches have identical flow cross sections.

6. The electrode as claimed in claim 5, wherein:

the flow cross section of the inlet channel section is equal to a sum of the flow cross sections of the inlet channel branches, and the flow cross section of the outlet channel section is equal to a sum of the flow cross sections of the outlet channel branches.

7. The electrode as claimed in claim 6, comprising a first electrode part having:

a cylindrical first section adapted for introduction into a recess formed in the component to be anodized, in whose outer surface the plurality of electrolyte exit openings and the plurality of electrolyte entry openings are formed spaced apart from one another along a longitudinal axis of the electrode and/or along whose outer surface the electrolyte flow path runs, and/or a flange section extending radially from the outer surface of the first section, wherein the flange section has a first end face facing the component to be anodized during operation of the electrode, the first end face of the flange section carrying a seal which is adapted to seal an electrolysis gap defined by the outer surface of the first section and an inner surface of the recess formed in the component to be anodized during operation of the electrode, and/or a further cylindrical section extending along the longitudinal axis of the electrode from a second end face of the flange section which faces away from the component to be anodized during operation of the electrode.

8. The electrode as claimed in claim 7, wherein:

the first electrode part is penetrated by a through-bore extending along the longitudinal axis of the electrode, wherein a section of the through-bore forms the outlet channel section and/or wherein the through-bore is fluid-tightly sealed by means of a further seal adjacent an end facing the component to be anodized during operation of the electrode, and/or inlet channel branches formed in the first electrode part extend from the second end face of the flange section in a flow direction of the electrolyte flowing through the inlet channel branches initially inclined radially inwardly to the electrolyte exit openings relative to the longitudinal axis of the electrode and subsequently inclined radially outwardly to the electrolyte exit openings relative to the longitudinal axis of the electrode, and/or outlet channel branches formed in the first electrode part extend radially inwardly from the electrolyte entry openings, parallel to sections of the inlet channel branches inclined radially outwardly relative to the longitudinal axis of the electrode, and open into the through-bore penetrating the first electrode part.

9. The electrode as claimed in claim 8, comprising a second electrode part adjacent to the first electrode part, wherein the second electrode part is penetrated by a through-bore extending along the longitudinal axis of the electrode which is adapted to accommodate the further cylindrical section of the first electrode part, and an inlet channel section formed in the second electrode part which has a ring-shaped flow cross section extends parallel to the longitudinal axis of the electrode from a first end face of the second electrode part facing the component to be anodized during operation of the electrode in a direction of a second end face of the second electrode part facing away from the component to be anodized during operation of the electrode, and in the second electrode part a first connecting channel connected to the electrolyte inlet informed which extends perpendicularly to the longitudinal axis of the electrode and/or forms a fluid-conducting connection between the electrolyte inlet formed in an outer surface of the second electrode part and the inlet channel section formed in the second electrode part.

10. The electrode as claimed in claim 9, comprising a third electrode part adjacent to the second electrode part having:

a main body and a cylindrical protruding section which extends along the longitudinal axis of the electrode and during operation of the electrode projects in a direction of the component to be anodized and adjacent to the further cylindrical section of the first electrode part is accommodated in the through-bore penetrating the second electrode part, wherein in the third electrode part a second connection channel connected to the electrolyte outlet is formed which comprises a first section which penetrates the protruding section along the longitudinal axis of the electrode and a second section running perpendicularly to the longitudinal axis of the electrode in the main body and/or forms a fluid-conducting connection between the electrolyte outlet formed in an outer surface of the third electrode part and the outlet channel section formed in the first electrode part.

11. An apparatus for anodizing a component, comprising:

an electrode as claimed in claim 1;

an electrolyte circuit for feeding electrolyte to the electrode and for discharging electrolyte from the electrode, wherein arranged in the electrolyte circuit are an electrolyte source and/or a conveying means for conveying the electrolyte through the electrolyte circuit, and a voltage source which is connectable to the component to be anodized and the electrode and is adapted for applying opposite voltages to the component and the electrode.

12. The apparatus as claimed in claim 11, further comprising a cooling apparatus for cooling the electrode, the component and/or the electrolyte, wherein the cooling apparatus is arranged in the electrolyte circuit and is adapted for cooling the electrolyte flowing through the electrolyte circuit.

13. A process for anodizing a component, comprising:

supplying an electrolyte to an electrode as claimed in claim 1 through the electrolyte inlet, passing the electrolyte through the inlet channel, passing the electrolyte through the plurality of electrolyte entry openings, passing the electrolyte through the electrolyte flow path, passing the electrolyte through the outlet channel, discharging the electrolyte from the electrode through the electrolyte outlet and applying a voltage to the component to be anodized and the electrode.

14. The process as claimed in claim 13, wherein:

a temperature of the electrolyte is set to −10° C. to +20° C., the voltage is increased from 0 V to a maximum voltage of 30 V over a defined period, so that in this period a current increases from 0 A to a current which is higher than 0 A but not more than 2 A and/or the electrolyte, the electrode and/or the component are cooled to remove heat formed during the anodization.

15. The process as claimed in claim 14, wherein a cylindrical first section of a first electrode part, in whose outer surface the plurality of electrolyte exit openings and the plurality of electrolyte entry openings are formed is introduced into a recess formed in the component to be anodized.

* * * * *